US010663164B2

(12) United States Patent
Rasi

(10) Patent No.: US 10,663,164 B2
(45) Date of Patent: May 26, 2020

(54) GAS BURNER ASSEMBLY

(71) Applicant: Electrolux Appliances Aktiebolag, Stockholm (SE)

(72) Inventor: Fabio Rasi, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 44 days.

(21) Appl. No.: 15/540,600

(22) PCT Filed: Feb. 1, 2016

(86) PCT No.: PCT/EP2016/052026
§ 371 (c)(1),
(2) Date: Jun. 29, 2017

(87) PCT Pub. No.: WO2016/128237
PCT Pub. Date: Aug. 18, 2016

(65) Prior Publication Data
US 2017/0370575 A1 Dec. 28, 2017

(30) Foreign Application Priority Data
Feb. 11, 2015 (EP) ..... 15154602

(51) Int. Cl.
*F23D 14/08* (2006.01)
*F24C 3/08* (2006.01)
*F23D 14/58* (2006.01)

(52) U.S. Cl.
CPC ..... *F23D 14/08* (2013.01); *F23D 14/58* (2013.01); *F23D 14/583* (2013.01); *F24C 3/08* (2013.01); *F24C 3/085* (2013.01)

(58) Field of Classification Search
CPC ..... F23D 14/06; F23D 14/08; F23D 14/58; F23D 14/583; F24C 3/08
(Continued)

(56) References Cited

U.S. PATENT DOCUMENTS 784,433 A * 3/1905 Roberts ..... F23D 14/045 126/214 R
1,138,416 A * 5/1915 Roberts et al. ..... F23D 14/06 431/354
(Continued)

FOREIGN PATENT DOCUMENTS

DE 29618892 U1 2/1998
EP 2799771 A2 11/2014
(Continued)

OTHER PUBLICATIONS

International Search Report and Written Opinion issued in International application No. PCT/EP2016/052026 dated Apr. 22, 2016, 10 pages.

*Primary Examiner* — Steven B McAllister
*Assistant Examiner* — Daniel E. Namay
(74) *Attorney, Agent, or Firm* — Pearne & Gordon LLP

(57) ABSTRACT

A gas burner assembly (10), in particular for a gas cooking hob, comprising a burner cap (12) and a burner body (14). The burner cap (12) is arranged or arrangeable upon the burner body (14). The burner cap (12) includes a plurality of flame ports (20). The flame ports (20) are formed within a horizontal portion or within a substantially horizontal portion of the burner cap (12). The burner body (14) includes a mixing chamber (22), a Venturi pipe (24), at least one air inlet (26), a gas injector (28) and a gas supply channel (36). At least the mixing chamber (22), the Venturi pipe (24), the at least one air inlet (26) and the gas supply channel (36) form a single-piece part. The flame ports (20) of the burner cap (12) are arranged above the mixing chamber (22) of the burner body (14), when the burner cap (12) is arranged upon the burner body (14).

17 Claims, 4 Drawing Sheets

Figure 1:
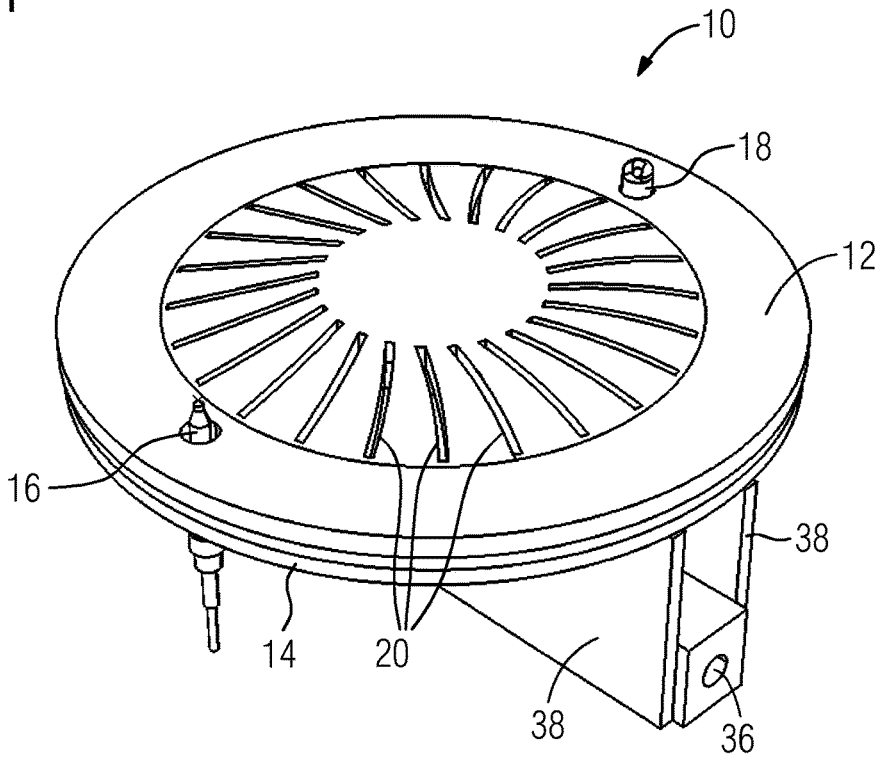

(58) Field of Classification Search
USPC ..... 126/39 E
See application file for complete search history.

(56) References Cited

U.S. PATENT DOCUMENTS

| | | | | | |
|---|---|---|---|---|---|
| 1,196,230 | A * | 8/1916 | Graves | F24C 3/085 | 126/39 R |
| 1,749,385 | A | 3/1930 | Kolts | | |
| 1,839,366 | A * | 1/1932 | Alig | F23D 14/06 | 239/559 |
| 1,869,942 | A * | 8/1932 | O'Dowd | F24C 3/085 | 126/39 K |
| 3,276,441 | A * | 10/1966 | Scherer | F24C 3/085 | 126/39 R |
| 3,589,620 | A * | 6/1971 | Davis | F23D 14/04 | 239/434 |
| 6,076,517 | A * | 6/2000 | Kahlke | F23D 14/64 | 126/39 E |
| 6,253,759 | B1 * | 7/2001 | Giebel | F23D 14/02 | 126/215 |
| 7,100,596 | B2 * | 9/2006 | Violi | F24C 15/322 | 126/21 A |
| 8,662,069 | B2 * | 3/2014 | Gasparini | F23D 14/08 | 126/39 H |
| 9,151,494 | B2 * | 10/2015 | Quintaba' | F23D 14/065 | |
| 9,612,018 | B2 * | 4/2017 | Bettinzoli | F23D 14/06 | |
| 9,625,159 | B2 * | 4/2017 | Quintaba' | F23D 14/085 | |
| 10,317,086 | B2 * | 6/2019 | Acosta Herrero | F24C 3/08 | |
| 2009/0277439 | A1 | 11/2009 | Gasparini | | |
| 2012/0070792 | A1 * | 3/2012 | Rasi | F23D 14/08 | 431/355 |
| 2012/0301837 | A1 * | 11/2012 | Akagi | F23D 14/08 | 431/328 |
| 2014/0338651 | A1 | 11/2014 | Hagstrom | | |
| 2018/0100655 | A1 * | 4/2018 | Aguilar | F24C 3/022 | |

FOREIGN PATENT DOCUMENTS

| | | | |
|---|---|---|---|
| ES | 2232211 | A1 | 5/2005 |
| WO | 2013065018 | A2 | 5/2013 |

* cited by examiner

GAS BURNER ASSEMBLY

The present invention relates to a gas burner assembly, in particular for a gas cooking hob. Further, the present invention relates to a gas cooking hob comprising at least one gas burner assembly.

A conventional gas burner assembly is composed of a number of components. Usually, the gas burner assembly comprises a gas injector, a Venturi pipe, a burner body, a flame spreader, a thermocouple element and a spark plug element. Further, the gas burner assembly requires a holding element for the gas injector. Moreover, the gas burner assembly requires connecting elements and/or fastening elements for fixing the components. For example, the holding element for the gas injector has to be connected to the burner body. Further, the thermocouple element and the spark plug element have to be fastened to the burner body. Such a gas burner assembly includes a high number of components and is therefore very expensive.

The flame spreader is often made of enameled steel, which impairs a good gas flow and is relative expensive. Moreover, a change of the gas injector requires usually the disassembling of the cooking appliance.

It is an object of the present invention to provide a gas burner assembly with an improved gas flow and a reduced number of components.

According to the present invention the gas burner assembly, in particular for a gas cooking hob, comprises a burner cap and a burner body, wherein

- the burner cap is arranged or arrangeable upon the burner body,
- the burner cap includes a plurality of flame ports,
- the flame ports are formed within a horizontal portion or within a substantially horizontal portion of the burner cap,
- the burner body includes a mixing chamber, a Venturi pipe, at least one air inlet, a gas injector and a gas supply channel,
- at least the mixing chamber, the Venturi pipe, the at least one air inlet and the gas supply channel form a single-piece part, and
- the flame ports of the burner cap are arranged above the mixing chamber of the burner body, when the burner cap is arranged upon the burner body.

The core of the present invention is that the flame ports are formed within the at least substantially horizontal portion of the burner cap and arranged above the mixing chamber of the burner body on the one hand and that the burner body with the mixing chamber, the Venturi pipe, the at least one air inlet forms a single-piece part on the other hand. The gas injector may be formed either as an integrated part burner body or as a separate part. In the latter case, the gas injector may be attached at the burner body by a screw thread or a plug connection, for example. The arrangement of the flame ports within the at least substantially horizontal portion of the burner cap and above the mixing chamber of the burner body improves the gas flow. The formation of the burner body with the mixing chamber, the Venturi pipe, the at least one air inlet and the gas injector as single-piece part reduces the number of components and the production costs. The arrangement of the gas injector at the burner body allows a change of said gas injector without disassembling the cooking appliance. The constellation of the gas burner assembly allows that the burner cap may be flush with a cooking surface of the gas cooking hob.

Preferably, the burner cap is made of cast iron. In particular, the burner cap is made by a sintering process. The sintered cast iron allows high quality and very good tolerances.

According to an embodiment of the present invention, the burner cap is formed as a circular disk.

Further, the burner cap may include at least one convex portion, wherein the flame ports are formed within said convex portion. Thus, the flame ports are formed within an inclined plane.

For example, the flame ports are formed as elongated slots extending along radial directions.

Preferably, the burner body is made of aluminium.

In particular, the Venturi pipe extends vertically downwards from the mixing chamber.

Further, the gas injector may be arranged below the Venturi pipe.

Moreover, the at least one air inlet is arranged between the gas injector and the Venturi pipe.

According to a preferred embodiment of the present invention, the burner body includes a base plate, an outer circumferential wall and an inner circumferential wall, wherein the mixing chamber is arranged between the outer circumferential wall and the inner circumferential wall.

In particular, the outer circumferential wall and inner circumferential wall of the burner body extend upward from the base plate of said burner body.

Further, the gas burner assembly may comprise at least one thermocouple element.

Additionally, the gas burner assembly may comprise at least one spark plug element.

At last, the present invention relates to a gas cooking hob comprising at least one gas burner assembly mentioned above.

Novel and inventive features of the present invention are set forth in the appended claims.

Figure 2:
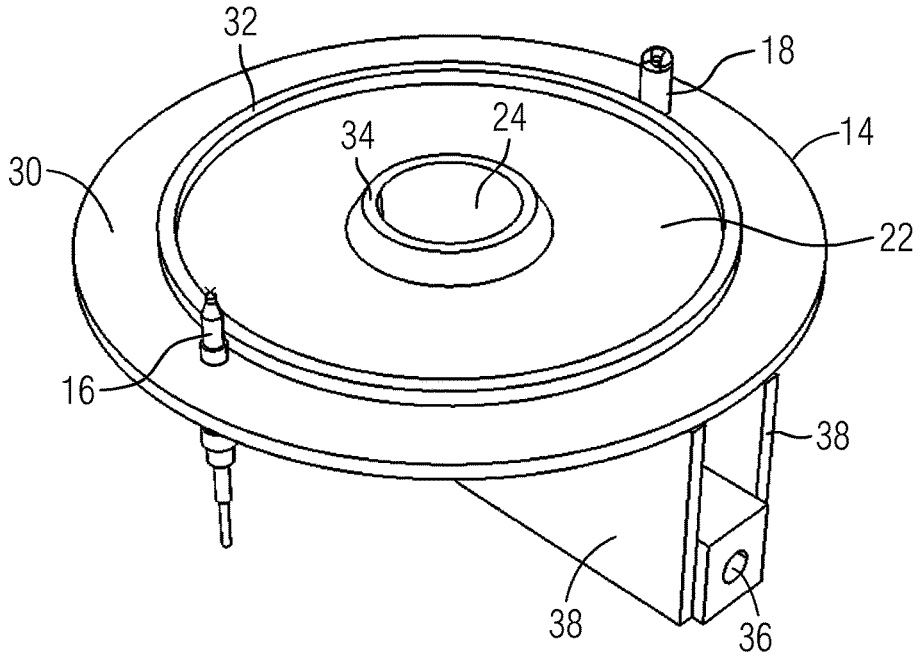
Figure 3:
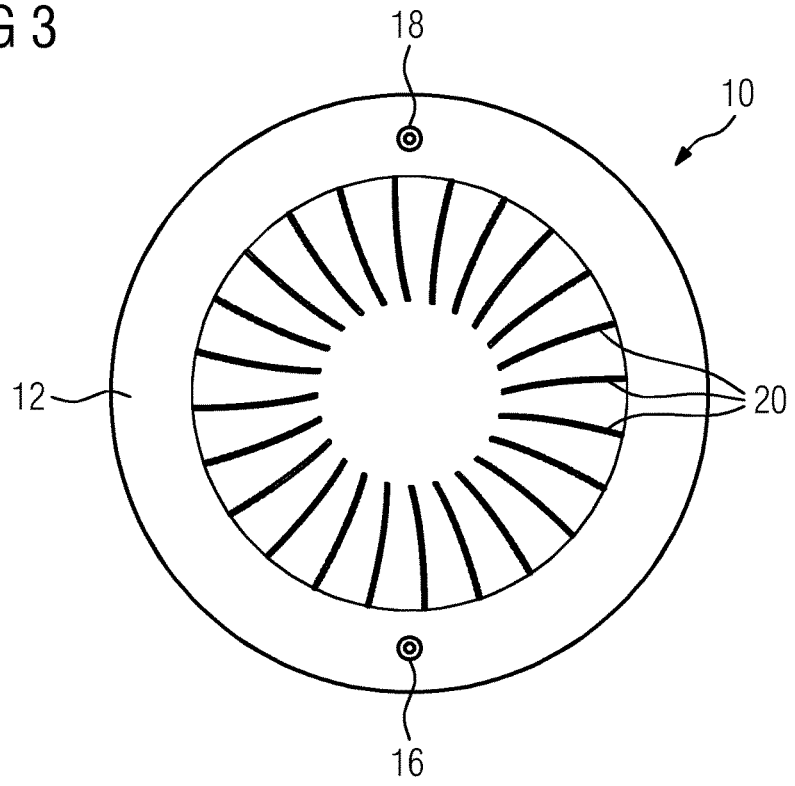
Figure 4:
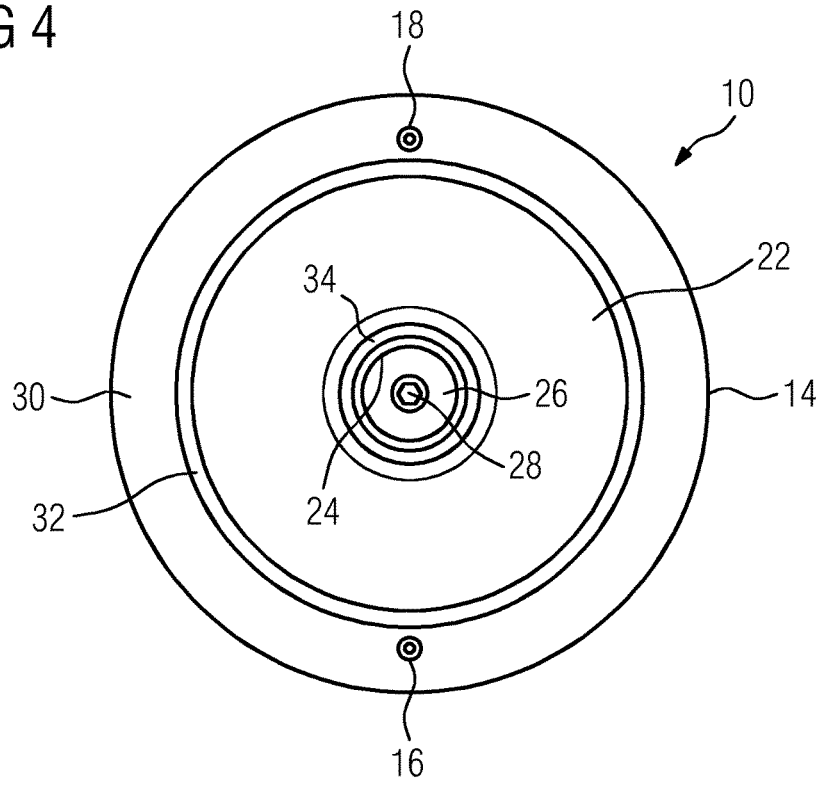
Figure 5:
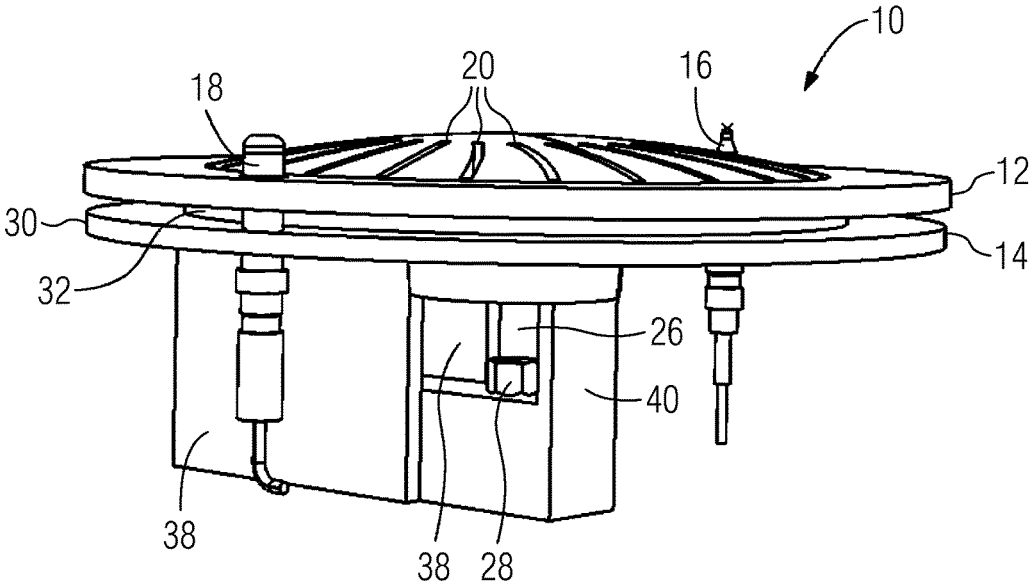
Figure 6:
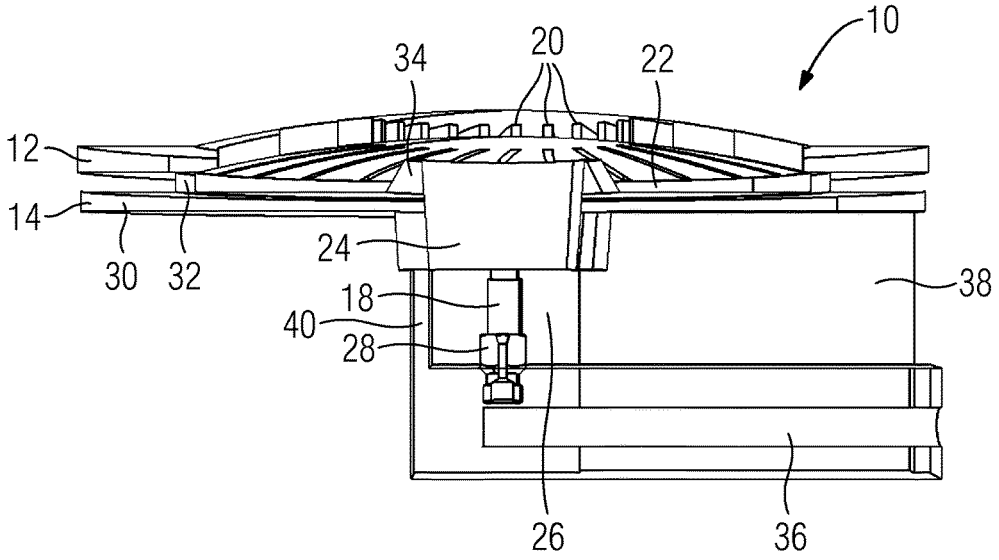
Figure 7:
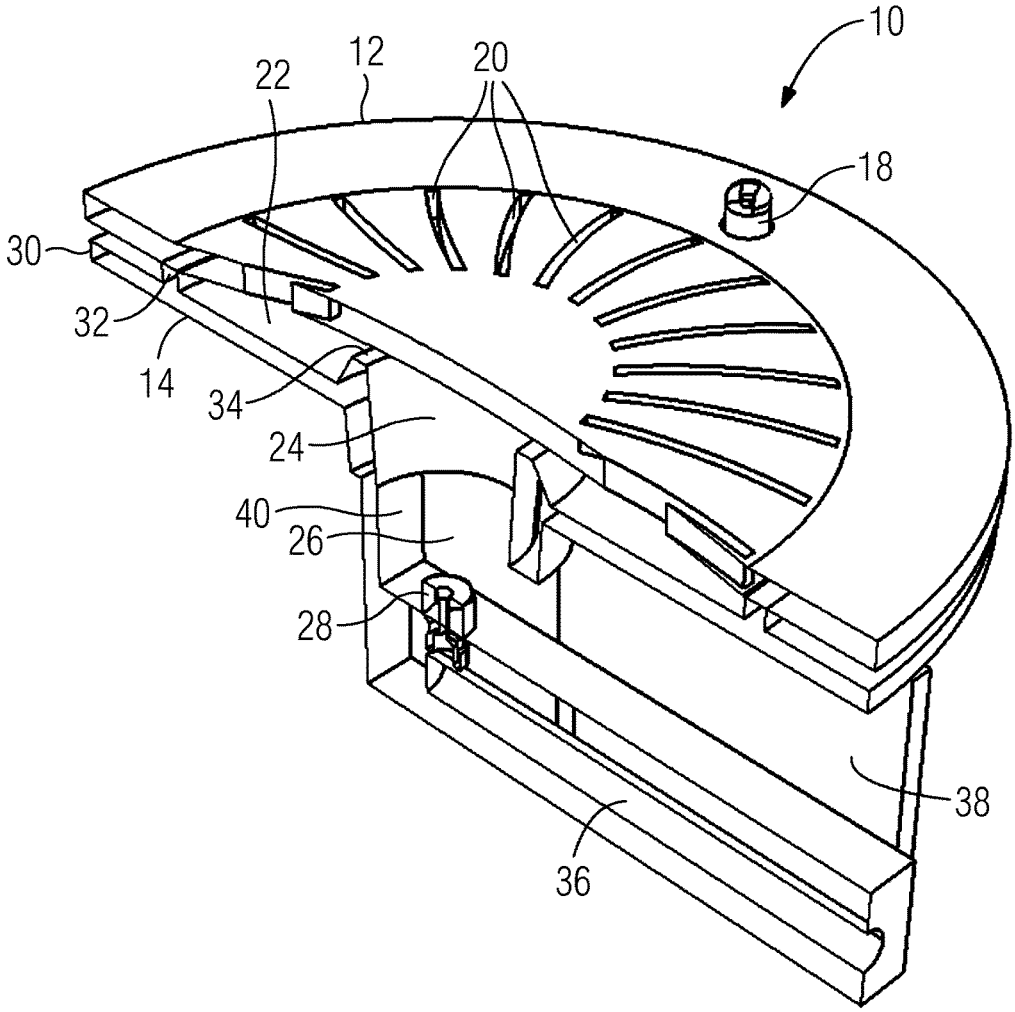

The present invention will be described in further detail with reference to the drawing, in which FIG. 1 illustrates a schematic perspective view of a gas burner assembly according to a preferred embodiment of the present invention, FIG. 2 illustrates a schematic perspective view of the gas burner assembly according to the preferred embodiment of the present invention, wherein a burner cap is removed, FIG. 3 illustrates a schematic top view of the gas burner assembly according to the preferred embodiment of the present invention, FIG. 4 illustrates a schematic top view of the gas burner assembly according to the preferred embodiment of the present invention, wherein the burner cap is removed, FIG. 5 illustrates a further schematic perspective view of the gas burner assembly according to the preferred embodiment of the present invention, FIG. 6 illustrates a schematic sectional side view of the gas burner assembly according to the preferred embodiment of the present invention, and FIG. 7 illustrates a schematic sectional perspective view of the gas burner assembly according to the preferred embodiment of the present invention.

FIG. 1 illustrates a schematic perspective view of a gas burner assembly 10 according to a preferred embodiment of the present invention. The gas burner assembly 10 comprises a burner cap 12, a burner body 14, a thermocouple element 16 and a spark plug element 18. The burner cap 12 is arranged above the burner body 14.

The burner cap 12 is formed as a substantially flat circular disk. In this example, a central portion of the burner cap 12 is convex. In particular, the burner cap 12 is made of cast iron. Preferably, the burner cap 12 is made by a sintering process. Said sintering process allows high quality and very good tolerances. The burner cap 12 includes a plurality of flame ports 20. In this example, the flame ports 20 are formed as slots, wherein said slots extend along radial directions in view of the circular burner cap 12. In general, the flame ports 20 may have different shapes. For example, the flame ports 20 may be round holes, long holes and/or squares. In this example, the flame ports 20 are formed within the convex central portion of the burner cap 12. The burner cap 12 or at least the portion of the flame ports 20 acts as a flame spreader.

The thermocouple element 16 penetrates an outer portion of the burner cap 12. The thermocouple element 16 is arranged out of the flame ports 20, but in contact with the flames. The spark plug element 18 penetrates an outer portion of the burner cap 12. The spark plug element 18 is arranged out of the flame ports 20.

The burner body 14 includes an elongated gas supply channel 36 in its lower portion. The gas supply channel 36 is arranged between two vertical support panels 38 of said burner body 14. The planes of the vertical support panels 38 extend parallel to the longitudinal axis of the gas supply channel 36. The gas supply channel 36 extends horizontally from the border to the centre of the burner body 14.

FIG. 2 illustrates a schematic perspective view of the gas burner assembly 10 according to the preferred embodiment of the present invention, wherein the burner cap 12 is removed. In particular, FIG. 2 clarifies the structure of the burner body 14.

The burner body 14 includes a mixing chamber 22, a Venturi pipe 24, one or more primary air inlets 26 and a gas injector 28. The bottom and the side wall of the mixing chamber 22 are formed by a portion of the burner body 14, while the top side of said mixing chamber 22 is formed by the central portion of the burner cap 12. In this example, the mixing chamber 22 has the form of an outer portion of a flat cylinder. The Venturi pipe 24 extends vertically downwards from the centre of the mixing chamber 22. The gas injector 28 is arranged below the Venturi pipe 24. The one or more primary air inlets 26 are arranged between the gas injector 28 and the Venturi pipe 24. The burner body 14 with the mixing chamber 22, the Venturi pipe 24, the one or more primary air inlets 26 and the gas supply channel 36 is formed as a single-piece part. In this example, the gas injector 28 is formed either as a separate part. The gas injector 28 may be attached at the gas supply channel 36 by a screw thread or a plug connection. Alternatively, the gas injector 28 may be formed either as an integrated part of the burner body 14 and/or gas supply channel 36. Preferably, the burner body 14 with the mixing chamber 22, the Venturi pipe 24, the one or more primary air inlets 26, the gas injector 28, the gas supply channel 36 and the support panels 38 is made of aluminium.

In this example, the burner body 14 includes a base plate 30, an outer circumferential wall 32 and an inner circumferential wall 34. The base plate 30 extends horizontally. The outer circumferential wall 32 and the inner circumferential wall 34 extend upward from said horizontal base plate 30. The mixing chamber 22 is arranged between the outer circumferential wall 32 and the inner circumferential wall 34. A portion of the base plate 30 forms the bottom of the mixing chamber 22. Further, the inner side of the inner circumferential wall 34 forms an upper portion of the Venturi pipe 24.

FIG. 3 illustrates a schematic top view of the gas burner assembly 10 according to the preferred embodiment of the present invention.

The burner cap 12 includes the plurality of flame ports 20 formed as elongated slots. Said elongated slots extend along radial directions in view of the circular burner cap 12. The flame ports 20 are arranged in the convex portion of the burner cap 12. The mixing chamber 22 of the burner body 14 is arranged below the flame ports 20. The thermocouple element 16 and the spark plug element 18 are arranged in the portion of the burner cap 12.

FIG. 4 illustrates a schematic top view of the gas burner assembly 10 according to the preferred embodiment of the present invention, wherein the burner cap 12 is removed.

The mixing chamber 22 is arranged between the outer circumferential wall 32 and the inner circumferential wall 34. The outer side of the inner circumferential wall 34 limits the mixing chamber 22, while the inner side of said inner circumferential wall 34 forms the upper portion of the Venturi pipe 24. The gas injector 28 is arranged below the Venturi pipe 24 and at an inner end and on an upper side of the gas supply channel 36. The one or more primary air inlets 26 are arranged between the gas injector 28 and the Venturi pipe 24. The primary air inlets 26 are formed by connecting elements between the Venturi pipe 24 and the gas injector 28. The primary air inlets 26 may be formed by the interspaces between said connecting elements. The gas injector 28 is connected or connectable via the gas supply channel 36 to a gas pipe.

FIG. 5 illustrates a further schematic perspective view of the gas burner assembly 10 according to the preferred embodiment of the present invention.

The thermocouple element 16 and the spark plug element 18 penetrate the outer portion of the burner cap 12 and the base plate 30 of the burner body 14. The thermocouple element 16 is arranged out of the flame ports 20, but in contact with the flames. The spark plug element 18 penetrates an outer portion of the burner cap 12. The spark plug element 18 is arranged out of the flame ports 20.

Further, FIG. 5 clarifies the arrangement of the gas injector 28 and the primary air inlets 26. The gas injector 28 is arranged below the Venturi pipe 24. The inlets 26 are formed as interspaces between the support panels 38 and a connecting part 40. Said connecting part 40 links the inner end of the gas supply channel 36 to the Venturi pipe 24.

FIG. 6 illustrates a schematic sectional side view of the gas burner assembly 10 according to the preferred embodiment of the present invention.

The burner cap 12 rests on the outer circumferential wall 32 of the burner body 14. In contrast, there is a distance between the inner circumferential wall 34 of the burner body 14 and the burner cap 12. The inner circumferential wall 34 forms an upper part of the Venturi pipe 24. The flame ports 20 are arranged above a circular ring between the outer circumferential wall 32 and the inner circumferential wall 34.

In this example, the portion of the burner cap 12 including the flame ports 20 is inclined between ten and twenty degrees. In general, the portion of the burner cap 12 including the flame ports 20 is inclined between zero and fifty degrees.

FIG. 7 illustrates a schematic sectional perspective view of the gas burner assembly 10 according to the preferred embodiment of the present invention.

The burner cap 12 rests directly on the outer circumferential wall 32 of the burner body 14, while the inner circumferential wall 34 of the burner body 14 is spaced from the burner cap 12. The Venturi pipe 24 is spaced from the gas injector 28. The primary air inlets 26 are arranged below the Venturi pipe 24.

The gas burner assembly 10 adopts a bottom breather technology. Primary air from an inner space of the cooking appliance is caught by the one or more primary air inlets 26. The gas and the primary air are conveyed through the Venturi pipe 24 into the mixing chamber 22. Flames are generated above the flame ports 20. The flames are provided for heating a cooking vessel arranged upon the gas burner assembly.

Since the burner body 14, including the mixing chamber 22, the Venturi pipe 24, the one or more primary air inlets 26 and the gas injector 28, is formed as a single-piece part, the number of components and the costs of the gas burner assembly 10 are reduced. The gas injector 28 may be changed without disassembling the cooking appliance. The gas burner assembly 10 allows an improved gas flow. The burner cap 12 is flat or nearly flat and may be an integrated part of a cooking hob, wherein the burner cap 12 is flush with the cooking surface.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 gas burner assembly
12 burner cap
14 burner body
16 thermocouple element
18 spark plug element
20 flame port
22 mixing chamber
24 Venturi pipe
26 primary air inlet
28 gas injector
30 base plate
32 outer circumferential wall
34 inner circumferential wall
36 gas supply channel
38 support panel
40 connecting part

The invention claimed is:

1. A gas burner assembly for a gas cooking hob, comprising a burner cap and a burner body, wherein the burner cap is arranged or arrangeable upon the burner body, the burner cap includes a plurality of flame ports, the flame ports are formed within a horizontal portion or within a substantially horizontal portion of the burner cap, the burner body includes a mixing chamber, a Venturi pipe, at least one air inlet, a gas supply channel and a gas injector, at least the mixing chamber, the Venturi pipe, the at least one air inlet and the gas supply channel forming a single-piece part without the use of connecting elements and/or fastening elements for fixing the mixing chamber, the venturi pipe, the at least one air inlet, and the gas supply channel; and the flame ports of the burner cap are arranged above the mixing chamber of the burner body, when the burner cap is arranged upon the burner body.

2. The gas burner assembly according to claim 1, wherein the burner cap is made of cast iron.

3. The gas burner assembly according to claim 2, wherein the burner cap is made by a sintering process.

4. The gas burner assembly according to claim 1, wherein the burner cap is formed as a circular disk.

5. The gas burner assembly according to claim 1, wherein the burner cap includes at least one convex portion, wherein the flame ports are formed within said convex portion.

6. The gas burner assembly according to claim 1, wherein the flame ports are formed as elongated slots extending along radial directions.

7. The gas burner assembly according to claim 1, wherein the burner body is made of aluminum.

8. The gas burner assembly according to claim 1, wherein the Venturi pipe extends vertically downwards from the mixing chamber.

9. The gas burner assembly according to claim 1, wherein the gas injector is arranged below the Venturi pipe.

10. The gas burner assembly according to claim 1, wherein the at least one air inlet is arranged between the gas injector and the Venturi pipe.

11. The gas burner assembly according to claim 1, wherein the burner body includes a base plate, an outer circumferential wall and an inner circumferential wall, wherein the mixing chamber is arranged between the outer circumferential wall and the inner circumferential wall of the burner body.

12. The gas burner assembly according to claim 11, wherein the outer circumferential wall and the inner circumferential wall of the burner body extend upward from the base plate of the burner body.

13. The gas burner assembly according to claim 1, wherein the gas burner assembly comprises at least one thermocouple element.

14. The gas burner assembly according to claim 1, wherein the gas burner assembly comprises at least one spark plug element.

15. A gas cooking hob comprising at least one gas burner assembly, characterized in that the gas cooking hob comprises at least one gas burner assembly according to claim 1.

16. A gas burner assembly comprising:

a burner body comprising a base plate, an outer circumferential wall and an inner circumferential wall, said outer and inner circumferential walls extending upward from said base plate and defining therebetween a mixing chamber, an inner surface of said inner circumferential wall defining an upper portion of a Venturi pipe, said Venturi pipe further extending downward from said mixing chamber, said base plate, outer and inner circumferential walls and Venturi pipe all being formed together as a single piece without the use of connecting elements and/or fastening elements for fixing the base plate, the outer and inner circumferential walls, and the venturi pipe;

a gas injector arranged below the Venturi pipe and a primary air inlet arranged between said gas injector and said Venturi pipe; and a burner cap formed as a sintered circular disk having a convex central portion, and a plurality of flame ports in said convex central portion;

said burner cap being arranged on and extending substantially horizontally over the burner body such that said convex central portion defines an upper wall of said mixing chamber and said flame ports are disposed above said mixing chamber.

17. The gas burner assembly according to claim 16, said flame ports comprising radially extending elongated slots, said convex portion of said burner cap being inclined at an angle of 10 to 20 degrees in the location of said slots, a thermocouple element penetrating an outer portion of the burner cap in a location outside said flame ports but where the thermocouple element will be in contact with flames emanating from said ports in use, and a sparkplug element penetrating an outer portion of the burner cap in a location outside said flame ports, said air inlet being formed by connecting elements between said Venturi pipe and said gas injector.

* * * * *